US007845792B2

(12) United States Patent
Hiroki et al.

(10) Patent No.: US 7,845,792 B2
(45) Date of Patent: Dec. 7, 2010

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 859 days.

(21) Appl. No.: 11/619,713

(22) Filed: Jan. 4, 2007

(65) Prior Publication Data

US 2008/0165218 A1 Jul. 10, 2008

(51) Int. Cl.
*B41J 29/13* (2006.01)

(52) U.S. Cl. ..... 347/108

(58) Field of Classification Search ..... 347/108, 347/109

See application file for complete search history.

(56) References Cited

U.S. PATENT DOCUMENTS 5,475,413 A * 12/1995 Hashimoto et al. ..... 347/108
6,155,730 A * 12/2000 Nakayama et al. ..... 400/613
6,250,623 B1 * 6/2001 Koakutsu et al. ..... 271/3.14
2006/0279612 A1 * 12/2006 Umeda et al. ..... 347/85
2008/0165215 A1 7/2008 Hiroki et al.
2008/0165220 A1 7/2008 Hiroki et al.
2008/0165231 A1 7/2008 Hiroki et al.
2008/0165236 A1 7/2008 Hiroki et al.
2008/0165238 A1 7/2008 Hiroki et al.
2008/0165239 A1 7/2008 Hiroki et al.
2008/0165240 A1 7/2008 Hiroki et al.
2008/0165241 A1 7/2008 Hiroki et al.
2008/0165242 A1 7/2008 Hiroki et al.

FOREIGN PATENT DOCUMENTS

JP 2006-219235 8/2006
JP 2006-225075 8/2006

* cited by examiner

*Primary Examiner*—Stephen D Meier
*Assistant Examiner*—Alexander C Witkowski
(74) *Attorney, Agent, or Firm*—Turocy & Watson, LLP

(57) ABSTRACT

An image forming apparatus includes a sheet guide that guides a sheet carried by a carrier mechanism in a first casing, a second casing that is mounted rotatably via a support shaft on the first casing and that is opened and closed about the support shaft, and a recording head that is provided in this second casing and that ejects ink to the sheet guided by the sheet guide while moving along a moving path orthogonal to a direction of carrying the sheet and thus records an image thereon, and that, after the end of this recording operation, moves to a standby position on one end side of the moving path and waits there.

20 Claims, 8 Drawing Sheets

METHOD AND APPARATUS FOR FORMING IMAGE

BACKGROUND OF THE INVENTION

1. Field of the Invention

The present invention relates to an image forming apparatus for printing an image on a medium, for example, a print sheet or the like, and particularly to an image forming apparatus having an ink jet recording head and an image forming method.

2. Description of the Related Art

As an image forming apparatus of this type, an apparatus has been known that has a carrier path for carrying a sheet into the apparatus body and that ejects ink from a recording head to the sheet carried by this carrier path and thereby forms an image thereon, as disclosed in JP-A-2006-219235, for example.

Normally, a sheet guide (medium guide) faces the recording head at a distance, and ink is ejected to a sheet guided along this sheet guide.

Meanwhile, in the printing operation, ink mist is generated around the recording head and the sheet guide is particularly stained with this ink mist. If the sheet guide is stained with the ink mist, when guiding the following sheets, the sheets might be stained.

Thus, traditionally, the sheet guide is periodically cleaned.

However, traditionally, since the sheet guide is provided fixedly in the apparatus body, when cleaning the sheet guide, a cleaning tool must be inserted into the apparatus body and the work must be done in the narrow space. Therefore, there are problems of poor operability and difficulty in confirming the cleaning effect.

As another means for cleaning the sheet guide, a technique of inserting a cleaning paper (for example, blank paper) into the sheet guide and eliminating the strain on the sheet guide with this paper has been carried out.

However, this case is uneconomical because paper is wasted.

BRIEF SUMMARY OF THE INVENTION

In view of the foregoing circumstances, it is an object of an aspect of the invention to provide an image forming apparatus and an image forming method that enable easy cleaning of a medium guide that guide a medium.

An image forming apparatus according to an aspect of the invention includes a first casing, a carrier device that is provided in this first casing and that carries a medium, a medium guide that guides the medium carried by this carrier device, a second casing that is mounted rotatably via a support shaft on the first casing and that is opened and closed about the support shaft, and a recording device that is provided in this second casing and that ejects ink to the medium guided by the medium guide while moving along a moving path orthogonal to a direction of carrying the medium and thus records an image thereon, and that, after the end of this recording operation, moves to a standby position on one end side of the moving path and waits there.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, embodiments of the invention will be described in detail with reference to the drawings.

Figure 1:
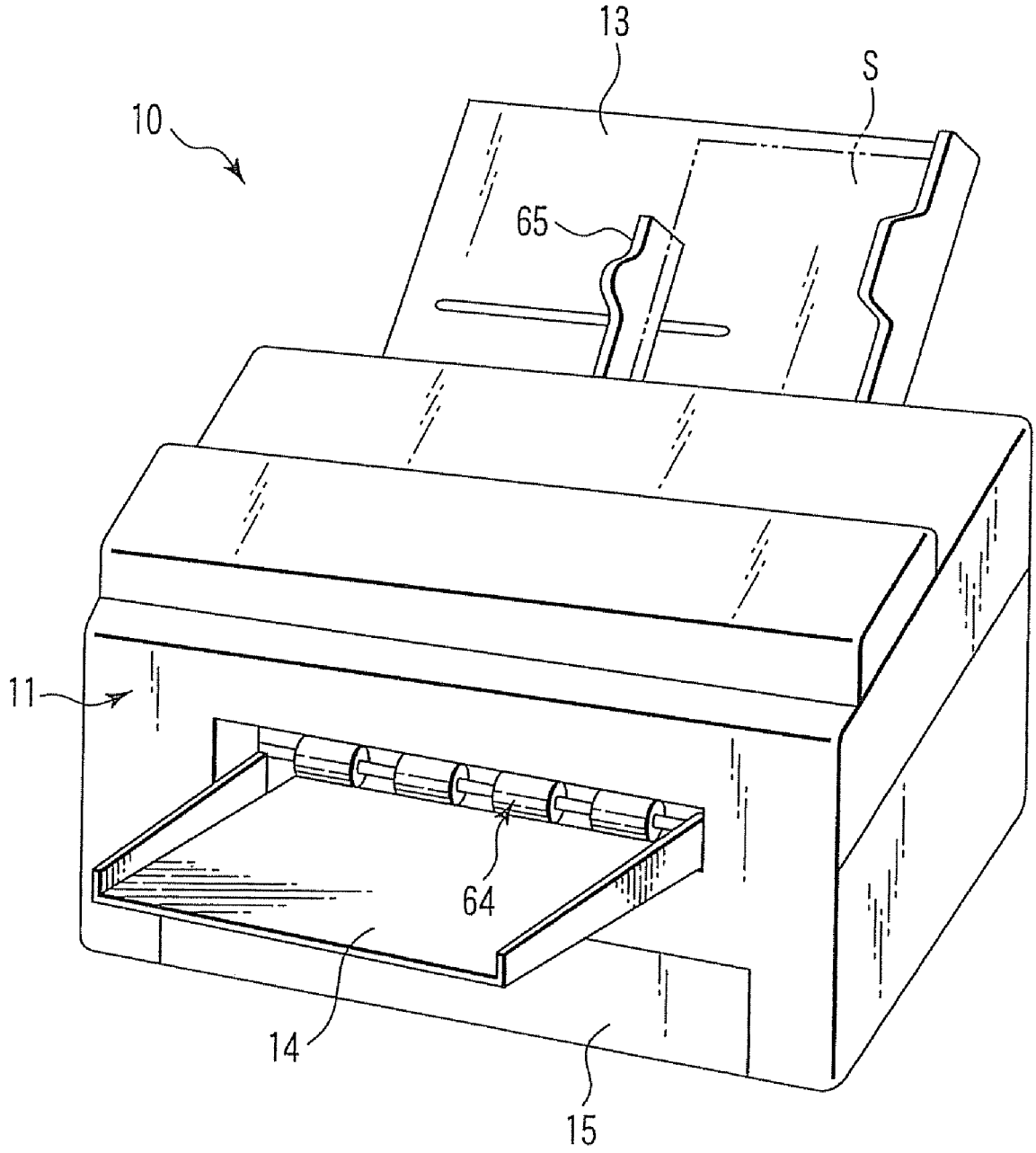
FIG. 1 is an external perspective view of appearance showing an image forming apparatus that is a first embodiment of the invention.

FIG. 1 is an external perspective view of appearance showing an image forming apparatus that is a first embodiment of the invention.

An image forming apparatus 10 has an apparatus body 11. A first supply tray 13 is arranged on the rear side of this apparatus body 11, and a discharge tray 14 is arranged on the forward side. A second supply tray 15 is provided on the lower side of the apparatus body.

Figure 2:
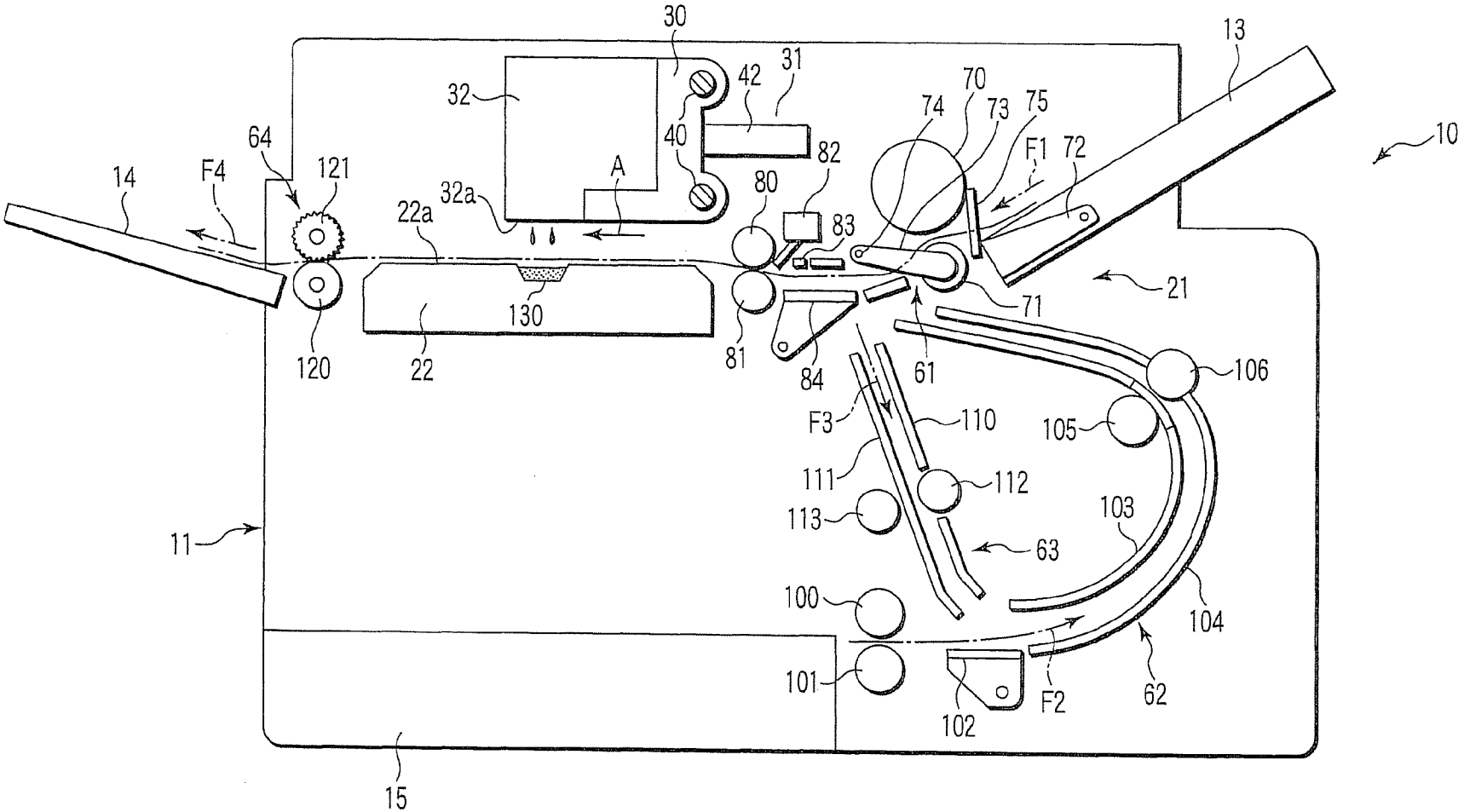
FIG. 2 is an internal configuration view showing the image forming apparatus of FIG. 1.

FIG. 2 schematically shows the internal configuration of the image forming apparatus 10. The apparatus body 11 includes therein a sheet carrier mechanism 21 as a carrier device, a sheet guide 22 as a medium guide having a horizontal guide surface 22*a*, a head cleaning mechanism 24 shown in FIG. 3, and the like. The sheet guide 22 and the head cleaning mechanism 24 will later be described in detail.

A carriage 30, a carriage driving mechanism 31 for driving this carriage 30, a recording head 32 as an ink jet recording device loaded in the carriage 30, and the like are arranged above the sheet guide 22. A replaceable ink cartridge (not shown) is housed in the recording head 32.

As shown in FIG. 2, the recording head 32 has a nozzle part 32*a* facing the guide surface 22*a* of the sheet guide 22, and an ink ejection mechanism (not shown) that ejects ink from this nozzle part 32*a*. The recording head 32 forms an image on a sheet S (shown in FIG. 3) with this ink. An arrow A in FIG. 3 shows the direction of carrying the sheet S.

An exemplary ink ejection mechanism is a thermal type. In the thermal type, the ink is heated by a heater arranged within the recording head 32, thereby causing film boiling of the ink. As bubbles are caused to grow or contract by this film boiling, a change in pressure occurs in the ink. This change in pressure causes the ink to be ejected from the nozzle part 32*a*, thereby forming an image on the sheet S. Other than the thermal type, for example, an ink ejection mechanism using a device having a piezoelectric effect (for example, a piezo device) may be employed. For example, the piezo device is deformed by a current and a pumping effect based on the deformation causes the ink to be ejected from the nozzle part.

Figure 3:
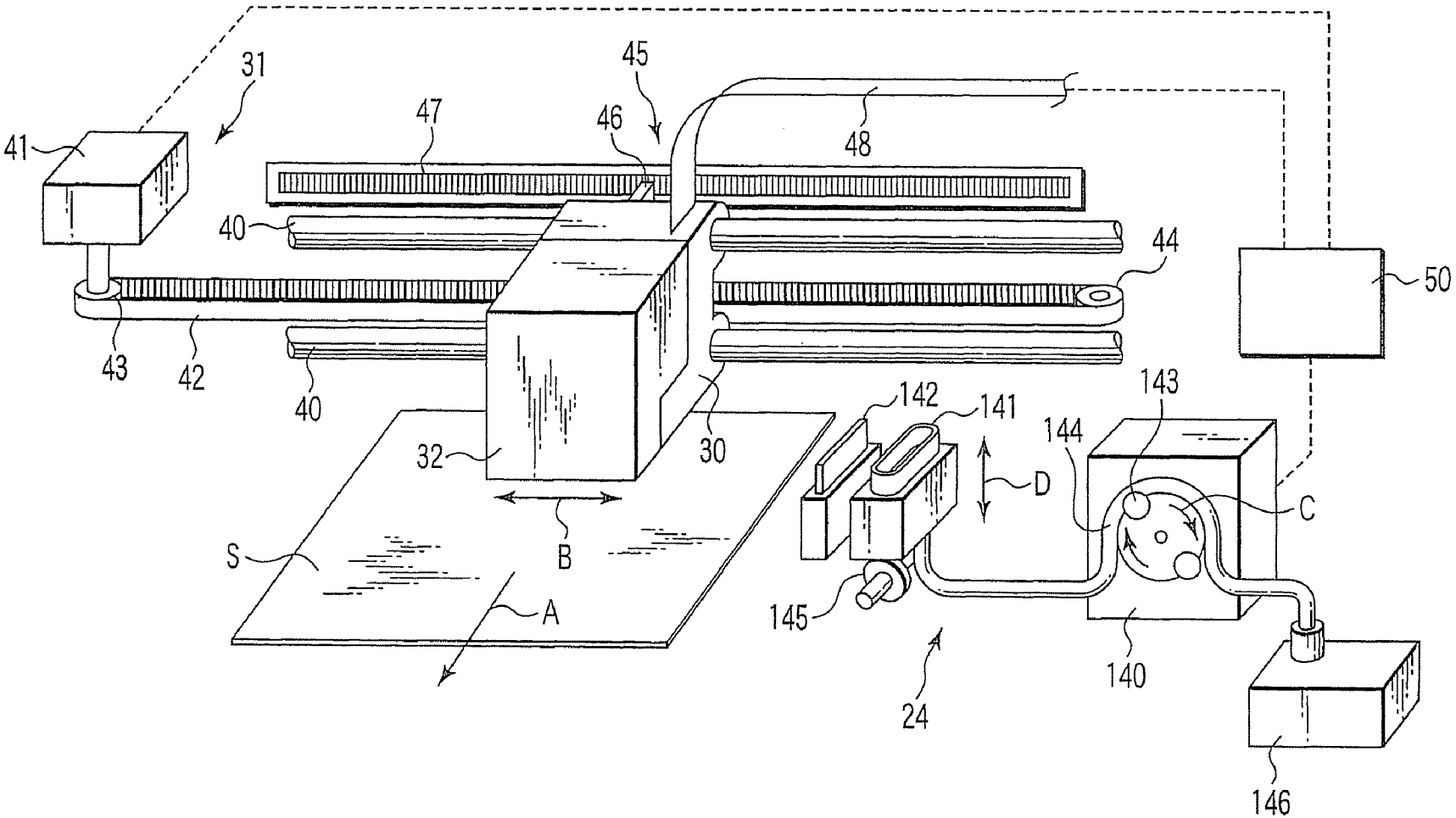
FIG. 3 is a perspective view showing a moving mechanism and a cleaning mechanism of a recording head of FIG. 2.

As shown in FIG. 3, the carriage driving mechanism 31 has a carriage guide 40 extending horizontally, a motor 41 such as a stepping motor, power transmission members including a timing belt 42 and sprockets 43, 44, a sensor unit 45 for controlling the position of the carriage 30, and the like. The carriage guide 40 extends in a direction B that is orthogonal to the direction of carrying the sheet S. The carriage guide 40 is supported by the frame of the apparatus body 11. The recording head 32, together with the carriage 30, is reciprocated along the carriage guide 40 in the direction (the direction of the arrow B) perpendicular to the direction of carrying the sheet S.

The rotation of the motor 41 is transmitted to the carriage 30 via the timing belt 42. Therefore, the recording head 32 reciprocates along the carriage guide 40. The sensor unit 45 for controlling the position of the carriage 30 has, for example, an encoder sensor 46 and a ladder plate 47 as a part to be detected. The ladder plate 47 extends in a direction parallel to the carriage guide 40. The ladder plate 47 has ladder patterns formed at equal pitches. As a ladder pattern of the ladder plate 47 is optically detected by the encoder sensor 46 in accordance with the position of the carriage 30, the position of the carriage 30 is detected. The detected position signal is inputted to a control unit 50 via a flexible harness 48.

As shown in FIG. 2, the sheet carrier mechanism 21 includes a first carrier part 61, a second carrier part 62, a double-side print carrier part 63 used when carrying out double-side print, a discharge mechanism 64, and the like.

The first carrier part 61 carries a sheet taken out from the first supply tray 13 toward the recording head 32. The second carrier part 62 carries a sheet taken out from the second supply tray 15 toward the recording head 32. The discharge mechanism 64 is responsible for the function of discharging a printed sheet onto the discharge tray 14.

Plural sheets (for example, print sheets) can be stacked in the direction of the thickness and thus set on the first supply tray 13. As shown in FIG. 1, a movable guide 65 is provided on the first supply tray 13. The movable guide 65 is movable in the direction of the width of the sheet S in accordance with the size of the sheet S. As this movable guide 65 is moved in the direction of the width of the sheet S, the position of the sheet S in the direction of the width on the first supply tray 13 can be regulated.

The first carrier part 61 includes a supply roller 70, a separation roller 71 situated below the supply roller 70, a separation unit 72 including a separation pad, and the like. The supply roller 70 supplies a sheet taken out from the lower edge of the first supply tray 13 toward the recording head 32. The separation roller 71 is provided with a torque limiter. When there is only one sheet between the supply roller 70 and the separation roller 71, the separation roller 71 with the function of the torque limiter rotates in the same direction as the supply roller 70. When there are two or more sheets between the supply roller 70 and the separation roller 71, the separation roller 71 rotates in the opposite direction to the supply roller 70. Therefore, when plural sheets are taken out from the first supply tray 13 and sent in between the supply roller 70 and the separation 71, the uppermost sheet is separated from the other sheets and only the uppermost sheet is supplied to the recording head 32. The supply roller 70, the separation roller 71, the separation unit 72 and the like form a sheet separation mechanism for taking out sheets one by one from the first supply tray 13.

The separation roller 71 is held by a holder 73. The holder 73 is movable upward and downward about a horizontally extending shaft 74. The separation roller 71 is abutted against the supply roller 70 with a predetermined load by a spring, and it is moved away from the supply roller 70 by a cam, not shown. The separation unit 72 can be moved in directions toward and away from the supply roller 70 by a cam, not shown.

After a sheet is supplied, the separation roller 71 and the separation unit 72 are moved away from the supply roller 70 to their standby positions and wait for the next sheet supply. A return lever 75 is rotatably arranged near the lower edge of the first supply tray 13. When a sheet taken out from the first supply tray 13 is carried toward the supply roller 70, the return lever 75 caused to retreat by a spring to a position where it will not prevent the carrying of the sheet. This return lever 75 turns synchronously with the movement of the separation roller 71 and the separation unit 72 to the standby positions, and returns the remaining sheets to the first supply tray 13.

The first carrier part 61 has a carrier roller 80, a pinch roller 81 facing this carrier roller 80, a sheet sensor 82, a medium sensor 83, a switch member 84, and the like. The carrier roller 80 supplies a sheet between the sheet guide 22 and the recording head 32. The sheet sensor 82 has a sensor arm capable of detecting the forward edge and the rear edge of a sheet.

The medium sensor 83 has a function of detecting the quality of a sheet (for example, paper quality). For example, in the case where a sheet has a hygroscopic surface, the medium sensor 83 outputs to the control unit 50 a signal that causes increase in the amount of ink to be ejected from the recording head 32. On the other hand, in the case where a sheet has a glossy surface, for example, a coated paper (coat paper), it is controlled to output to the control unit 50 a signal that causes decrease in the amount of ink to be ejected from the recording head 32. Also, in the case of color print, the proportion of plural color elements to be ejected may be adjusted on the basis of a signal from the medium sensor 83.

Figure 4:
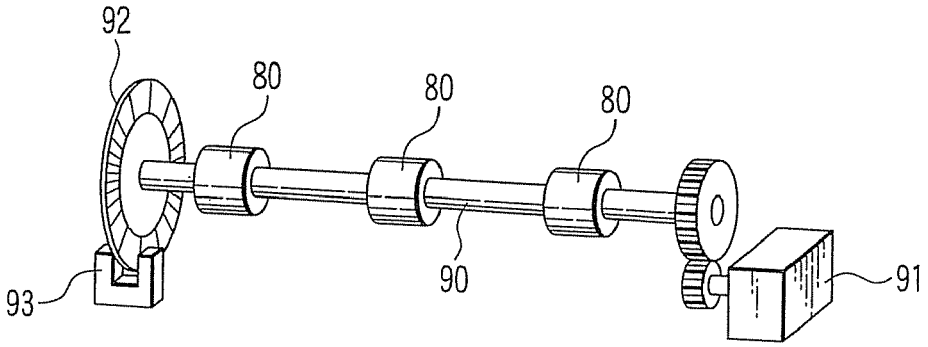
FIG. 4 is a perspective view showing a driving mechanism of a carrier roller of FIG. 2.

As shown in FIG. 4, the carrier roller 80 is mounted on a shaft 90. The shaft 90 is rotated by a controllable motor 91 such as a stepping motor. The pinch roller 81 facing the carrier roller 80 is abutted against the carrier roller 80 by a spring, not shown. A disc-shaped ladder wheel 92 is mounted on the shaft 90 of the carrier roller 80. In the ladder wheel 92, ladder patterns are formed at predetermined pitches in the circumferential direction. This ladder wheel 92 is detected by a sensor 93 and it is inputted to the control unit 50. Thus, the rotation of the carrier roller 80 is controlled and the carrying of the sheet is controlled at the time of forming an image.

The sheet taken out from the first supply tray 13 by the supply roller 70 passes through the first carrier part 61 as indicated by an arrow F1 in FIG. 2 and is carried in between the carrier roller 80 and the pinch roller 81. The distal end of the sheet is detected by the sheet sensor 82 and the sheet is positioned for image formation. As the carrier roller 80 rotates, this sheet passes between the upper surface (guide surface 22*a*) of the sheet guide 22 and the recording head 32. During this passage, an image is formed on the sheet S by the recording head 32. Ribs that function as a carrying reference surface are formed on the guide surface 22*a* of the sheet guide 22. These ribs properly maintain the height of the sheet and prevent the sheet from becoming wavy. The sheet on which an image has been formed is carried toward the discharge mechanism 64.

The second carrier part 62 has rollers 100, 101 for taking out a sheet from the cassette-type second supply tray 15, a switch member 102, guide members 103, 104 for guiding the sheet that has been taken out, a carrier roller 105 provided at an intermediate part of the guide members 103, 104, and a pinch roller 106 facing the carrier roller 105. The pinch roller 106 is pressed to the carrier roller 105 by a spring. Plural sheets (for example, print sheets) can be stacked in the direction of the thickness and thus housed in the second supply tray 15. The rollers 100, 101 of the second carrier part 62 function as a sheet separation mechanism for taking out the sheets one by one from the second supply tray 15.

The sheet taken out from the second supply tray 15 passes over the switch member 102 as indicated by an arrow F2 in FIG. 2 and passes between the guide members 103, 104 of the second carrier part 62. This sheet is further carried by the rollers 105, 106 toward the carrier roller 80 and supplied between the recording head 32 and the sheet guide 22.

The double-side print carrier part 63 has guide members 110, 111, a carrier roller 112 provided at an intermediate part of the guide members 110, 111, a pinch roller 113 facing the carrier roller 112, and the like. The pinch roller 113 is pressed to the carrier roller 112 by a spring. The guide members 110, 111 are arranged between the switch member 84 of the first carrier part 61 and the switch member 102 of the second carrier part 62. At the time of double-side printing, a sheet is passed in a direction of an arrow F3 in FIG. 2. The carrier rollers 80, 105 and 112 are formed by providing a rubber-like resin such as EPDM (ethylene propylene diene rubber) on a metal shaft and have a function of carrying the sheet S by friction.

In the case of carrying out double-side print, after printing is performed on one side of the sheet by the recording head 32, the rear edge of this sheet is detected by the sheet sensor 82. Immediately after that, the carrier roller 80 rotates backward and the position of the switch member 84 changes. Thus, the sheet is sent to the double-side print carrier part 63 as indicated by the arrow F3 in FIG. 2. This sheet is further carried by the rollers 112, 113, passes over the switch member 102, and passes between the guide members 103, 104 of the second carrier part 62. The sheet thus turns upside down. As this sheet is sent again to the recording head 32 by the carrier roller 80, printing is performed on the other side of the sheet.

The discharge mechanism 64 has a discharge roller 120, a star wheel 121, a transmission mechanism (not shown) for transmitting the rotation of the carrier roller 80 to the discharge roller 120 and the star wheel 121, and the like. The star wheel 121 is a gear-like wheel made of a thin plate of stainless steel or the like. The sheet on which print has been made by the recording head 32 is carried toward the discharge tray 14 in a direction indicated by an arrow F4 while it is pressed to the discharge roller 120 by the star wheel 121. This star wheel 121 prevents the printed sheet from floating up from the discharge roller 120.

Figure 5:
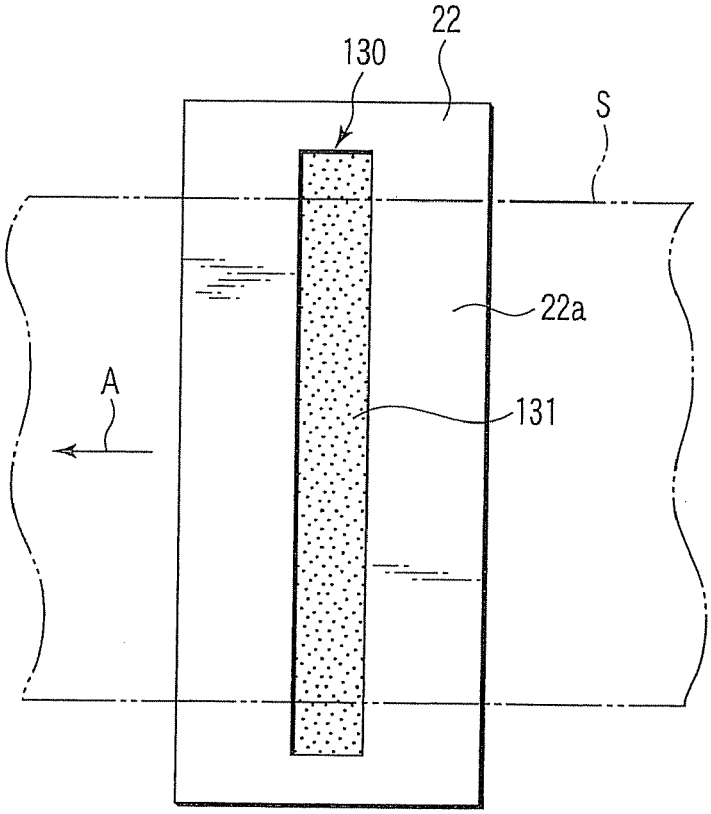
FIG. 5 is a plan view showing a sheet guide of FIG. 2.

As shown in FIG. 5, an ink absorbing part 130 is formed on the upper side of the sheet guide 22. This ink absorbing part 130 is formed at a position facing the nozzle part 32*a* of the recording head 32 (shown in FIG. 2) and lower than the guide surface 22*a*. The width of the ink absorbing part 130 is larger than the width of the sheet S, and for example, a spongy ink absorber 131 is housed in this ink absorbing part 130. In the case of carrying out unframed print on the sheet, excess ink pushed out from the edge of the sheet is absorbed by this ink absorber 131, and the following sheets are thus prevented from being stained.

The head cleaning mechanism 24 shown in FIG. 3 has a suction pump 140 for cleaning the recording head 32, a cap 141 for preventing the recording head 32 from drying, a blade member 142 for cleaning the nozzle part 32*a* of the recording head 32, and the like. In an example of the suction pump 140, a rotating body 143 squeezes a tube 144 in a direction indicated by an arrow C, thereby generating a negative pressure within the cap 141.

The cap 141 can be moved vertically (the direction of an arrow D in FIG. 3) by a driving mechanism 145. The driving mechanism 145 uses an electrically driven actuator 146 such as a solenoid to vertically move the cap 141. The cap 141 may also be vertically moved by converting the rotation of the motor into linear motion by a cam or a link mechanism. In maintenance of the recording head 32, the cap 141 is moved up toward the recording head 32 and the cap 141 is thus brought closely in contact with the recording head 32. As the suction pump 140 is actuated in this state, the excess ink adhering to the nozzle part 32*a* of the recording head 32 is sucked. The sucked waste ink is discharged into a waste ink tank 146. After that, the cap 141 moves away from the recording head 32, and the nozzle part 32*a* of the recording head 32 is further cleaned by the blade member 142.

Figure 6:
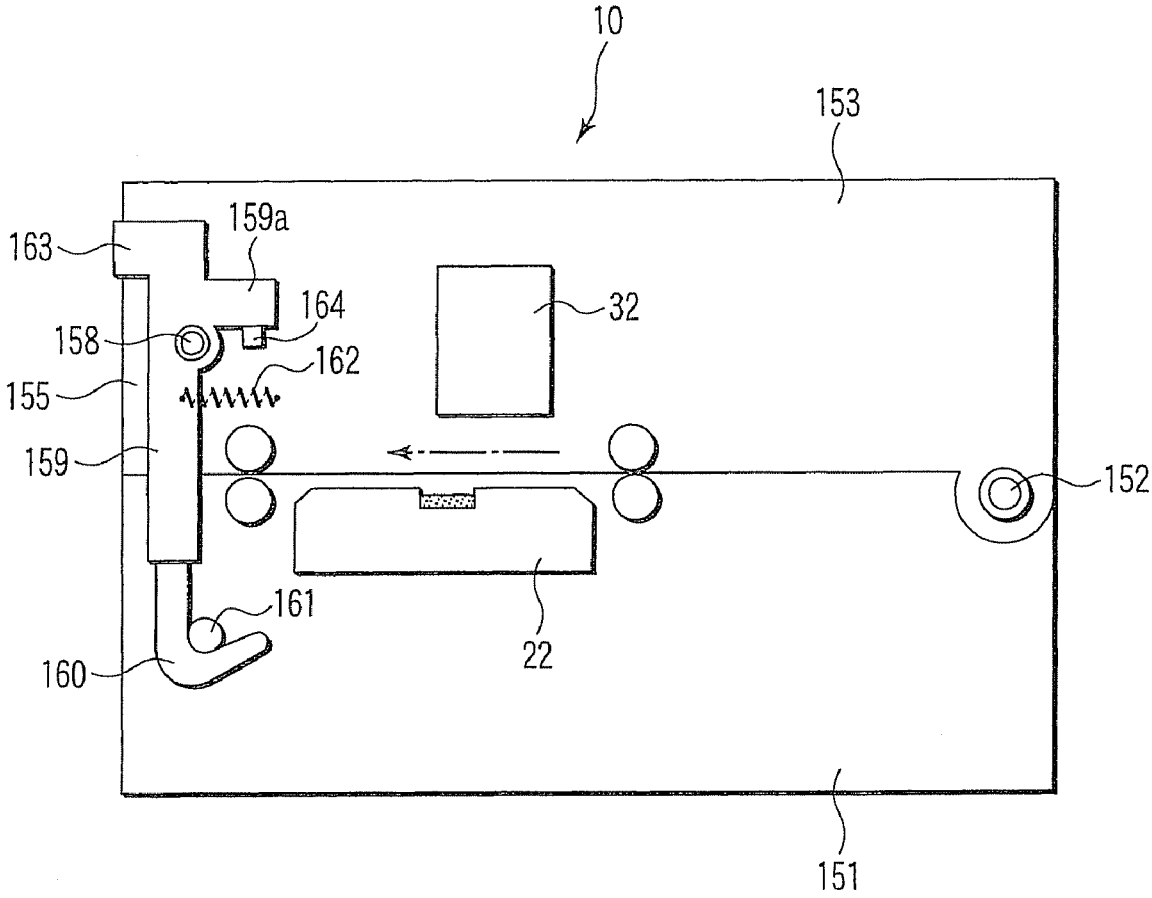
FIG. 6 is a view showing a configuration of an apparatus body of FIG. 1.
Figure 7:
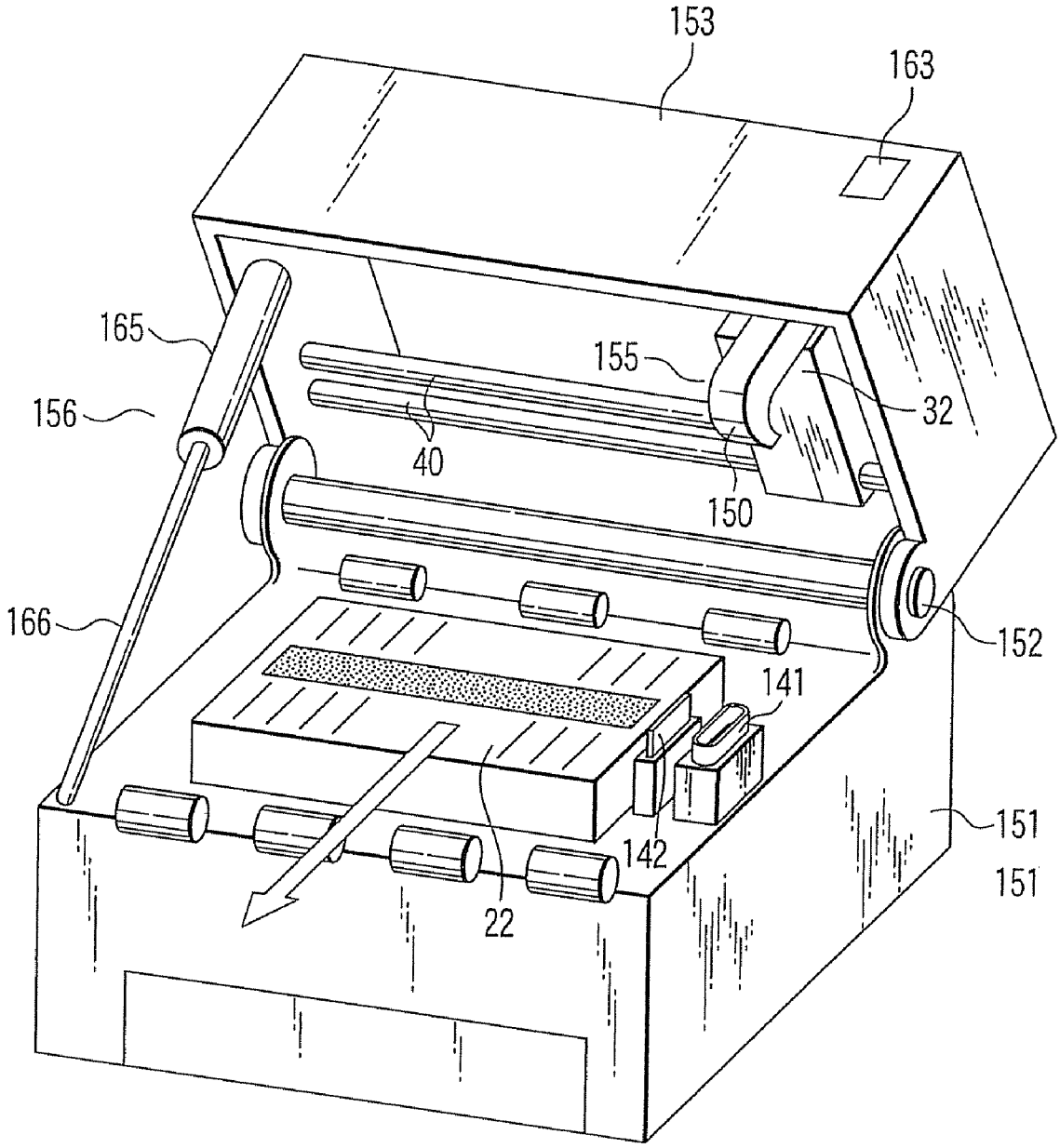
FIG. 7 is a view showing a state where an upper casing of FIG. 6 is opened.

Meanwhile, the above-described apparatus body 11 is formed by a lower casing 151 as a first casing and an upper casing 153 as a second casing attached to the lower casing 151 via a support shaft 152, as shown in FIG. 6. The upper casing 153 is configured to open and close as it rotates about the support shaft 152 as shown in FIG. 7. The support shaft 152 is provided along a direction orthogonal to the sheet carrying direction indicated by an arrow (the direction of the arrow). The front-side end of the upper casing 153 is the rotating end.

The above recording head 32, its moving mechanism and the like are arranged in the upper casing 153, and the above sheet guide 22 and the like are arranged in the lower casing 151. Therefore, when the upper casing 153 is opened upward, the recording head 32 and its moving mechanism are caused to move upward and retreat from the sheet guide 22.

When this upper casing 153 is opened, the recording head 32 is caused to move and retreat to one end side of the carriage guide 40 so that the user can be prevented from touching the recording head 32 and the leaking ink from the recording head 32 can be prevented from staining the carrier path.

At the rotating end on the front side of the upper casing 153, a lock mechanism 155 for locking the upper casing 153 to the lower casing 151, and a damper mechanism 156 for pushing the upper casing 153 upward are provided.

The lock mechanism 155 has a lock lever 159 that rotates about a support shaft 158, and a hook part 160 formed on the lower end side of the lock lever 159. The hook part 160 is retained by a fixed pin 161 provided in the lower casing 151 in a manner that enables engagement and disengagement. A spring member 162 is connected to the lock lever 159, and the lock lever 159 is energized by the spring member 162 to rotate counterclockwise.

An operating part 163 is provided to protrude on the upper end side of the lock lever 159. This operating part 163 protrudes outward from the front side of the upper casing 153. As the operating part 163 is pushed in, the lock lever 159 rotates clockwise about the support shaft 158 against the energizing force of the spring member 162. Thus, the hook part 160 of the lock lever 159 is disengaged from the fixed pin 161 and the lock is canceled.

The lock lever 159 is configured to be unable to operate unless the recording head 32 moves to the retreat position on the one end side of the carriage guide 40.

A stopper 164 is provided on the upper side of the lock lever 159. This stopper 164 is engaged with and disengaged from a protrusion 159*a* of the lock lever 159. As electricity is turned on and off, the stopper 164 is moved forward and backward and is thus engaged with and disengaged from the protrusion 159*a* of the lock lever 159. During a printing operation, the stopper 164 is engaged with the protrusion 159*a* of the lock lever 159 and disables the lock lever 159 from operating. When the printing operation has ended and the recording head 32 has returned to the retreat position, the stopper 164 is disengaged from the protrusion 159*a* of the lock lever 159 and enables the lock lever 159 to operate. As the operating part 163 is pressed in this operation-enabled state, the lock lever 159 operates and the lock of the upper casing 153 is canceled.

Also, an open-close button (not shown) may be provided on the operation panel of the apparatus body 11, and even when the recording head 32 is situated at a position other than the retreat position, the open-close button may be pressed, thus returning the recording head 32 to the retreat position and enabling the lock lever 159 to operate. In this case, there is no problem if the lock is automatically canceled and the upper casing 153 is half opened without pressing the operating part 163.

The damper mechanism 156 has a gas damper body 165, and an actuating member 166 connected to this gas damper body 165. The upper end side of the gas damper body 165 is connected to the upper casing 153, and the lower end side of the actuating member 166 is connected to the lower casing 151. The damper mechanism 156 constantly pushes the upper casing 153 with a predetermined force to open it upward.

Meanwhile, at the time of the above-mentioned printing, ink mist is generated around the recording head 32. This ink mist particularly stains the sheet guide 22. When the sheet guide 22 is stained with the ink mist, the following sheets will be stained when guiding these sheets. Therefore, the sheet guide 22 must be periodically cleaned.

Next, a cleaning method for the sheet guide 22 will be described.

In this case, first, the operating part 163 of the lock lever 159 is pushed in. This pushing causes the lock lever 159 to rotate clockwise about the support shaft 158 against the energizing force of the spring member 162, and its hook part 160 is disengaged from the fixed pin 161. The lock is thus canceled and the upper casing 153 is pushed up and opened by the damper mechanism 156. This opening causes the recording head 32 and its moving mechanism to move upward and retreat from the sheet guide 22. After the recording head 32 and its moving mechanism are thus caused to retreat upward, the sheet guide 22 is cleaned and other required parts are cleaned.

After the cleaning, the upper casing 153 is rotated downward and closed against the push-up force of the damper mechanism 156. This causes the hook part 160 of the lock lever 159 to be engaged with the fixed pin 161, and the upper casing 153 is locked to the lower casing 151.

According to this embodiment, the apparatus body 11 is formed by the upper and lower casings 153, 151 that can open and close. The recording head 32 is arranged in the upper casing 153, and the sheet guide 22 is arranged in the lower casing 151. As the upper casing 153 is opened, the recording head 32 is caused to retreat from the sheet guide 22. Thus, the sheet guide 22 can be exposed outward. Therefore, compared with the case of cleaning in the narrow space within the apparatus body 11 as in the traditional technique, the cleaning work becomes easier since the recording head 32 and the like does not obstruct the work.

Figure 8:
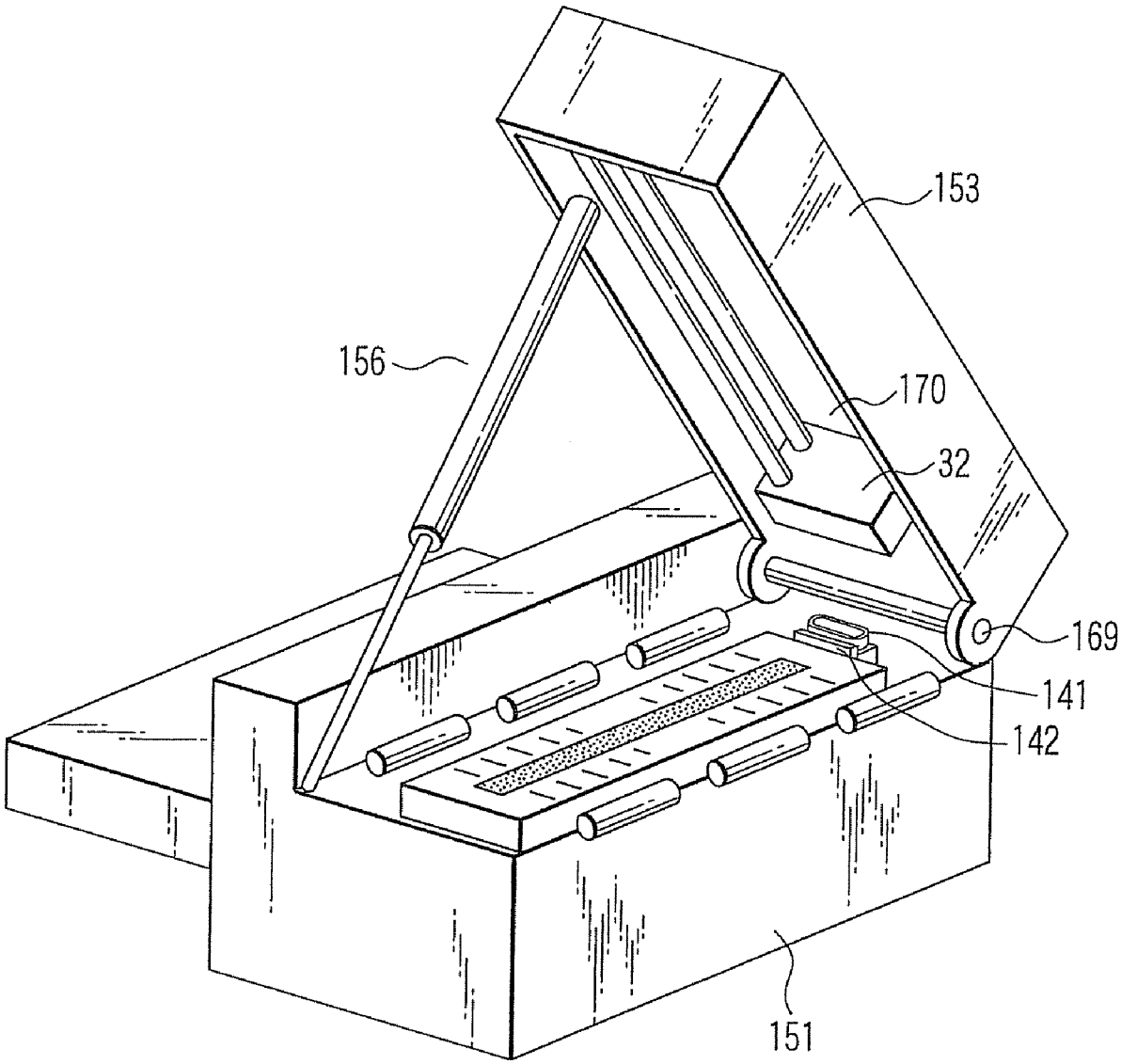
FIG. 8 is a perspective view showing an image forming apparatus that is a second embodiment of the invention.

FIG. 8 shows an image forming apparatus as a second embodiment of the invention.

The same parts as those described in the first embodiment are denoted by the same numerals and will not be described further in detail.

In the above first embodiment, the support shaft 152 that rotatably supports the upper casing 153 is provided in the direction orthogonal to the sheet carrying direction, and the apparatus body 11 is opened and closed on its front side. However, in this second embodiment, a support shaft 169 that rotatably supports the upper casing 153 is provided parallel to the sheet carrying direction, and the apparatus body 11 can be opened and closed on its lateral side.

At the rotating end on the lateral side of the upper casing 153, a lock mechanism (not shown) for locking the upper casing 153 to the lower casing 151, and the damper mechanism 156 for pushing up the rotating end side of the upper casing 153 are provided.

Figure 9:
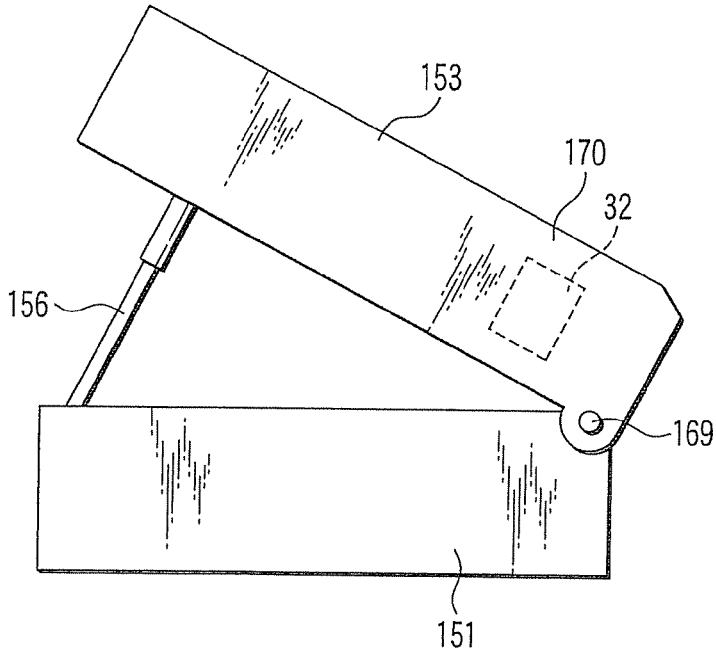
FIG. 9 is a side view showing the image forming apparatus of FIG. 8.

The recording head 32 moves along the moving path orthogonal to the sheet carrying direction as described above. However, when the printing operation has ended, the recording head 32 is moved to a standby position 170 one end side of the moving path, that is, on the rear side of the upper casing 153, as shown in FIG. 9, and thus caused to wait.

Also, the cap 141 for preventing the recording head 32 from drying, and a blade member 142 for cleaning the nozzle part 32*a* of the recording head 32 are provided on the rear side of the lower casing 151.

In this second embodiment, the support shaft 169 is provided on rear side of the upper casing 153 and situated closely to the standby position 170 of the recording head 32. Therefore, when the upper casing 153 is opened, a large length can be taken from the open end on its front side to the recording head 32, and the recording head 32 can be prevented from being touched at the time of cleaning.

Figure 10:
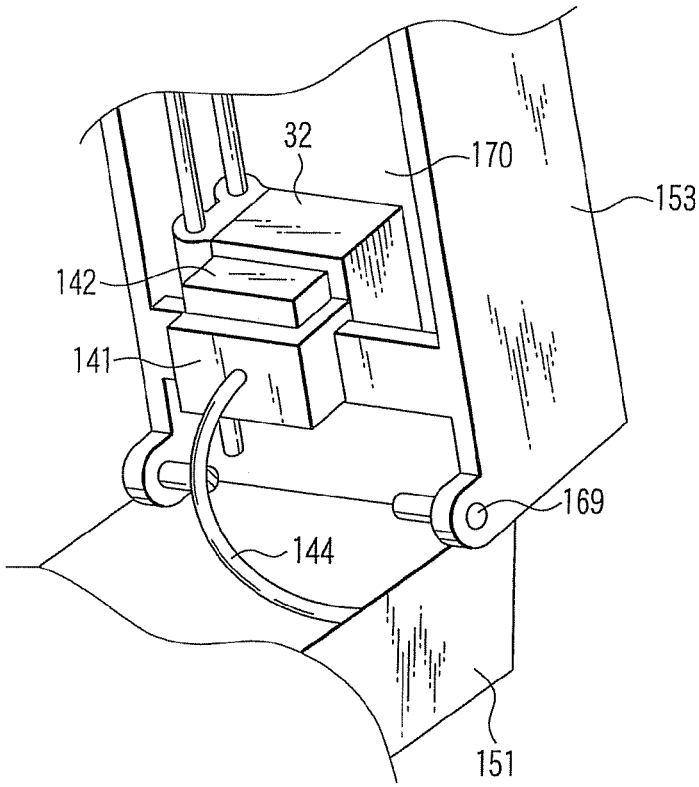
FIG. 10 is a perspective view showing an image forming apparatus that is a third embodiment of the invention.

FIG. 10 shows an image forming apparatus as a third embodiment of the invention.

In the above second embodiment, the cap 141 for preventing the recording head 32 from drying, and the blade member 142 for cleaning the nozzle part 32*a* of the recording head 32 are provided in the lower casing 151. However, in this third embodiment, the cap 141 and the blade member 142 are provided in the upper casing 153.

According to this third embodiment, when the upper casing 153 is opened, not only the operator and the surrounding can be prevented from being stained with ink, but also the recording head 32 can be prevented from drying. Particularly in the case where the user has trouble in cleaning, the opened state of the upper casing 153 may continue for a long period of time. Even in that case, there is an advantage that the recording head 32 can be prevented from drying.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a lower casing;

a carrier device provided in the lower casing and configured to carry a medium;

a medium guide configured to guide the medium carried by the carrier device;

an upper casing mounted rotatably via a support shaft on the lower casing and configured to be opened and closed about the support shaft;

and a recording device provided in the upper casing and configured to eject ink to the medium guided by the medium guide while moving along a moving path orthogonal to a direction of carrying the medium and thus record an image thereon.

2. The image forming apparatus according to claim 1, wherein the support shaft is provided along a direction orthogonal to the direction of carrying the medium.

3. The image forming apparatus according to claim 1, wherein the support shaft is provided parallel to the direction of carrying the medium.

4. The image forming apparatus according to claim 3, wherein the support shaft is provided closely to the standby position of the recording device.

5. The image forming apparatus according to claim 1, wherein the recording device is configured to move to a standby position on one end side of the moving path and wait there after the end of the recording operation, and the image forming apparatus comprises a cap provided in the upper casing and configured to cover the surface of the recording device when the recording device is moved to the standby position.

6. The image forming apparatus according to claim 1, comprising:

a lock mechanism configured to lock the upper casing to the lower casing; and a mechanism configured to disable the lock mechanism from operating during the recording operation of the recording device, and to enable the lock mechanism to operate when the recording operation of the recording device has ended and it has returned to the standby position.

7. The image forming apparatus according to claim 1, wherein when the upper casing is in an open state, an upper part of the medium guide is brought into an open state.

8. An image forming apparatus comprising:

a lower casing;

carrier means provided in the lower casing and for carrying a medium;

guide means for guiding the medium carried by the carrier means;

an upper casing mounted rotatably via a support shaft on the lower casing and configured to be opened and closed about the support shaft; and recording means provided in the upper casing and for ejecting ink to the medium guided by the guide means while moving along a moving path orthogonal to a direction of carrying the medium and thus recording an image thereon.

9. The image forming apparatus according to claim 8, wherein the support shaft is provided along a direction orthogonal to the direction of carrying the medium.

10. The image forming apparatus according to claim 8, wherein the support shaft is provided parallel to the direction of carrying the medium.

11. The image forming apparatus according to claim 10, wherein the support shaft is provided closely to the standby position of the recording means.

12. The image forming apparatus according to claim 8, wherein the recording means is configured to move to a standby position on one end side of the moving path and wait there after the end of the recording operation, and the image forming apparatus comprises a cap provided in the upper casing and configured to cover the surface of the recording means when the recording means is moved to the standby position.

13. The image forming apparatus according to claim 8, comprising:

lock means for locking the upper casing to the lower casing; and a mechanism configured to disable the lock means from operating during the recording operation of the recording means, and to enable the lock means to operate when the recording operation of the recording means has ended and it has returned to the standby position.

14. The image forming apparatus according to claim 8, wherein when the upper casing is in an open state, an upper part of the guide means is brought into an open state.

15. An image forming method comprising:

carrying a medium by a carrier device in a lower casing;

guiding the carried medium by a medium guide;

moving a recording device in an upper casing provided to be capable of opening and closing via a support shaft on the lower casing, along a moving path orthogonal to a direction of carrying the medium, ejecting ink from the recording device to the medium guided by the medium guide and thus recording an image thereon; and opening the upper casing when cleaning the medium guide.

16. The image forming method according to claim 15, wherein the recording device is configured to move to a standby position on one end side of the moving path and wait there after the end of the recording operation, and when the recording device is moved to the standby position, the surface of the recording device is covered with a cap in the upper casing.

17. The image forming method according to claim 15, comprising:

locking the upper casing to the lower casing by a lock mechanism; and disabling this lock mechanism from operating during the recording operation of the recording device, and enabling the lock mechanism to operate when the recording operation of the recording device has ended and it has returned to the standby position.

18. An image forming method comprising:

carrying a medium by carrier means in a lower casing;

guiding the carried medium by guide means;

moving recording means in an upper casing provided to be capable of opening and closing via a support shaft on the lower casing, along a moving path orthogonal to a direction of carrying the medium, ejecting ink from the recording means to the medium guided by the guide means and thus recording an image thereon; and opening the upper casing when cleaning the guide means.

19. The image forming method according to claim 18, wherein the recording means is configured to move to a standby position on one end side of the moving path and wait there after the end of the recording operation, and when the recording means is moved to the standby position, the surface of the recording means is covered with a cap in the upper casing.

20. The image forming method according to claim 18, comprising:

locking the upper casing to the lower casing by a lock mechanism; and disabling the lock mechanism from operating during the recording operation of the recording means, and enabling the lock mechanism to operate when the recording operation of the recording means has ended and it has returned to the standby position.

* * * * *